US008711005B2

(12) United States Patent
Musachio

(10) Patent No.: US 8,711,005 B2
(45) Date of Patent: Apr. 29, 2014

(54) VARIABLE SPEED TRAFFIC CONTROL SYSTEM

(76) Inventor: Nicholas R. Musachio, St. Paul, MN (US)

( * ) Notice: Subject to any disclaimer, the term of this patent is extended or adjusted under 35 U.S.C. 154(b) by 670 days.

(21) Appl. No.: 12/978,716

(22) Filed: Dec. 27, 2010

(65) Prior Publication Data

US 2012/0161982 A1 Jun. 28, 2012

(51) Int. Cl.
*G08G 1/00* (2006.01)

(52) U.S. Cl.
USPC ..... 340/932; 340/917

(58) Field of Classification Search
USPC ..... 340/932, 917
See application file for complete search history.

(56) References Cited

U.S. PATENT DOCUMENTS

| | | | | |
|---|---|---|---|---|
| 3,594,719 | A * | 7/1971 | Endo et al. | 340/913 |
| 4,463,427 | A | 7/1984 | Bonnetain et al. | |
| 5,381,155 | A * | 1/1995 | Gerber | 342/104 |
| 5,771,484 | A * | 6/1998 | Tognazzini | 701/117 |
| 5,822,711 | A | 10/1998 | Ochoa-Chavez | |
| 5,892,461 | A | 4/1999 | Dokko | |
| 6,008,740 | A | 12/1999 | Hopkins | |
| 6,864,784 | B1 | 3/2005 | Loeb | |
| 7,148,813 | B2 | 12/2006 | Bauer | |
| 7,167,104 | B2 | 1/2007 | DiPiazza | |
| 7,187,301 | B2 | 3/2007 | Lu | |
| 7,274,306 | B2 | 9/2007 | Publicover | |
| 7,342,510 | B2 | 3/2008 | Pate | |
| 7,439,853 | B2 | 10/2008 | Tengler et al. | |
| 7,466,227 | B2 | 12/2008 | Chen et al. | |
| 7,468,680 | B2 | 12/2008 | Heffernan | |
| 7,616,293 | B2 | 11/2009 | Sirota et al. | |
| 2003/0218551 | A1 | 11/2003 | Crocker et al. | |
| 2005/0104745 | A1 * | 5/2005 | Bachelder et al. | 340/906 |
| 2005/0134478 | A1 * | 6/2005 | Mese et al. | 340/901 |
| 2005/0237224 | A1 | 10/2005 | Gotfried | |
| 2007/0069920 | A1 | 3/2007 | Hakki et al. | |
| 2007/0198169 | A1 | 8/2007 | Nathan et al. | |
| 2007/0290886 | A1 | 12/2007 | Stam et al. | |
| 2008/0071460 | A1 | 3/2008 | Lu | |
| 2009/0135024 | A1 | 5/2009 | Park et al. | |
| 2009/0292456 | A1 | 11/2009 | Inoguchi et al. | |

FOREIGN PATENT DOCUMENTS

| | | |
|---|---|---|
| CN | 2073606 | 3/1991 |
| EP | 0848364 | 6/1998 |
| EP | 2040236 | 3/2009 |
| JP | 4130999 | 5/1992 |
| JP | 2008296798 | 12/2008 |
| WO | 0143104 | 6/2001 |
| WO | 2008007663 | 1/2008 |

OTHER PUBLICATIONS

Naystar Global Positioning System Interface Specification IS-GPS-200, Revision D, Dec. 7, 2004, Naystar GPS Space Segment/Navigation User Interface, ARINC Engineering Services, LLC.*

* cited by examiner

*Primary Examiner* — Daniel Wu
*Assistant Examiner* — Frederick Ott
(74) *Attorney, Agent, or Firm* — Krenz Hoff, LLP

(57) ABSTRACT

A variable speed limit sign including a controller and a display operatively coupled to the controller is provided. A traffic control system including a variable speed limit sign and methods of use thereof are also provided.

20 Claims, 5 Drawing Sheets

VARIABLE SPEED TRAFFIC CONTROL SYSTEM

BACKGROUND OF THE INVENTION

Current traffic control systems waste energy and increase pollution. It's estimated that about 62% of the United States miles driven are urban. Because of the lower fuel efficiency of urban driving, urban driving represents an estimated 80% of United States fuel consumption. In urban driving often 30%-50% fuel is wasted due to continual stopping, and congestion. Even in light traffic, traffic lights appear to operate randomly; they frustrate drivers, cause accidents, waste fuel, and increase pollution. One of the most common reasons for injurious accidents is a driver trying to make a light, going through a red light, and hitting cross traffic. The United States government estimates drivers stop over two times per mile in city traffic—ten times per mile in New York City traffic. That amounts to 24,000 stops per year for an urban driver travelling 12,000 miles. If the driver averages thirty seconds per stop, that would amount 100 hours per year at traffic lights.

In an attempt to move traffic more efficiently, reduce congestion, and lessen delays at stop lights, many solutions have been proposed. For example, smart traffic control systems are mostly based upon real time communication and interaction between devices such as sensors, lights, monitors, central control rooms, and the like. This interactivity typically requires wires, phone lines, modems, transmitters, computers, and radio frequency devices, which transmit and receive data between traffic controllers, for example, stoplights and directive signs. In this approach, the system reacts to the traffic and vice versa. Smart traffic systems are limited by being expensive and complex. Any system that relies upon communication between devices be it wire or wireless, will usually be unreliable and/or very expensive to implement. Any new wire, radio signal, sensor, is met with significant cost and implementation barriers. Further, the collective failure of all of these systems is that they try to reconcile what are basically two random variables, traffic lights and drivers, and one constant: the speed limit.

What is needed is a cheap and easy to implement traffic control system that avoid the disadvantages of the prior art.

SUMMARY OF THE INVENTION

This disclosure provides a variable speed limit sign that can be used in conjunction with a centrally controlled traffic control device to provide a traffic control system that can (1) reduce energy use by having vehicles avoid stopping at a traffic light, (2) reduce pollution by reducing energy use, (3) condition drivers to drive at the suggested speed by guaranteeing them a green light at the next intersection (4) make driving more pleasurable and safer by eliminating the uncertainty of making the next light, (5) eliminating the urge to speed to make the next light, (6) direct drivers drive in platoon fashion at the controlled intersections, arriving slightly after the light turns green, and exiting slightly before the light turns red, (7) create a simple, economical, and decentralized traffic system where each component is autonomous and reliable, (8) eliminate the annoying and dangerous cognitive dissonance that arises in the driver when the speed limit and the timing of lights are at odds with each other, and (9) reduce congestion by increasing traffic flow.

This disclosure allows drivers, who obey displayed, variable speed signs, to drive through an urban area without stopping for traffic lights. The disclosure also teaches how to build an economical and reliable system that can be implemented without the expense and complexity wired communication or radio frequency devices, sensors, or reactive or interactive real time computer controlled systems. This disclosure also prescribes a precise, simple, minimally directive, intuitive system for drivers to follow. This disclosure teaches a means of guaranteeing drivers leaving one intersection, a green light at the next. This disclosure displays to all drivers passing, a single speed to drive to reach the next intersection in time for a scheduled green light. The speed displayed will result in all drivers converging in a target area, near the next traffic light controlled intersection, in platoon fashion, when the light turns green. This disclosure is not hindered by weather, hills, obstacles, or distance. The only thing the driver needs to learn is to follow the posted speed limit. By lessening the number of stops, driver's mileage will increase; they will be happier, they will drive the prescribed speed, emissions will fall, and traffic will move more smoothly through intersections, a given road will be able to carry more traffic.

By using variable speed signs and precise, programmed, predictable schedules based in universal time, as well as giving drivers a single precise speed to travel, drivers are more likely to follow the posted speed. This disclosure follows a simple repetitive pattern: (1) go through an intersection; (2) read the speed sign; (3) drive that speed; and (4) the next light will be green as you approach. Additionally, by using precise traffic light schedules, and variable speeds, it will be possible to program an entire grid so that cross traffic may move without encountering red lights. By giving the driver a guarantee of a green light at the next intersection, most rational people will simply drive that speed. Conversely, by not driving the posted speed, a driver is probably going to hit a red light, and thus will have an incentive not to speed above the displayed speed directive. By guaranteeing the driver of an upcoming green light, drivers will become conditioned, remain calm, and drive predictably at legal speeds.

This disclosure uses precise programmed predictable schedules that are programmed and scheduled in universal time. As such, different traffic control jurisdictions can easily share scheduling information so that their traffic lights may be coordinated. By using such schedules a computer program will be able to model traffic flows in a grid, so that drivers can drive without stopping.

This disclosure does not require that the individual components communicate with each other. Each variable speed limit sign is a programmed, stand-alone unit that is autonomous from the traffic signals or other variable speed limit signs. Thus, a traffic control system that utilizes the variable speed limit sign is relatively simple, consumes little power, relatively tamperproof, economical, quickly installed, and robust. All that need be done is replace, or modify and reprogram existing computerized traffic light controllers. Then install specialized, stand alone, pre-programmed variable speed limit signs, with specialized controllers displaying the correct legal speed necessary to drive so as to make the next green light.

The present invention provides a variable speed limit sign. The variable speed limit sign includes: a controller including: a first radio clock with an output to synchronize the controller with a traffic control device synchronized by a second radio clock, wherein the traffic control device is programmed with a predictable output schedule; a programmable memory device containing the timing sequence of the upcoming traffic control device and one or more traffic schedules; a processor for determining the variable speed limit for a vehicle to maintain to avoid a stop signal at the upcoming traffic control device; and a display operatively coupled to the controller for communicating the variable speed limit to the vehicle.

In one embodiment, the first and second radio clocks are synchronized by a time code bit stream transmitted by one or more radio transmitters, wherein the one or more radio transmitters are connected to a time standard.

In one embodiment, the one or more radio transmitters each independently include a national time transmitter, a regional time transmitter, a satellite navigation system transmitter, or a combination thereof.

In one embodiment, the time standard is a radio controlled clock.

In one embodiment, the variable speed limit sign further includes a power source operatively coupled to the variable speed limit sign. In one embodiment, the power source includes a solar panel array, a battery, an external power source, or a combination thereof.

In one embodiment, the variable speed limit sign further includes a one or more sensors for determining road conditions, weather condition, traffic conditions, emergency conditions, or a combination thereof. In one embodiment, the variable speed limit sign further includes one or more signal receivers to receive one or more signals sent by the central control station or an emergency vehicle.

In one embodiment, the one or more signals instruct the controller to switch to a second traffic schedule. In one embodiment, the processor determines the variable speed limit by using the timing sequence of the upcoming traffic control device contained within the programmable memory device and the one or more traffic schedules.

In one embodiment, the processor includes override mechanism to provide a static speed limit to the display, a text message to the display, a symbol to the display, or a combination thereof. In one embodiment, the variable speed limit sign further includes a self-diagnosis device for verifying that the operation of the controller and the display are within predefined tolerances.

In one embodiment, the variable speed limit places the vehicle at the traffic control device at a precise universal time with a precise velocity and with a predetermined time delay so that the vehicle will not overtake a preceding vehicle. In one embodiment, the upcoming traffic control device is at an intersection, on a controlled merging on-ramp, or a combination thereof.

The present invention provides traffic control system. The traffic control system includes: a traffic control device that is preprogrammed by a central control station synchronized by a first radio clock; one or more variable speed limit signs for communicating with a first oncoming vehicle a variable speed limit to avoid a stop signal in the traffic control device including: a controller including: a first radio clock with an output to synchronize the controller with a traffic control device synchronized by a second radio clock, wherein the traffic control device is programmed with a predictable output schedule; a programmable memory device containing the timing sequence of the upcoming traffic control device and one or more traffic schedules; a processor for determining the variable speed limit for a vehicle to maintain to avoid a stop signal at the upcoming traffic control device; and a display operatively coupled to the controller for communicating the variable speed limit to the vehicle or optionally display, transmit, or display and transmit a programming status of the controller.

In one embodiment, the first and second radio clocks are synchronized by a time code bit stream transmitted by one or more radio transmitters, wherein the one or more radio transmitters are connected to a time standard.

In one embodiment, the traffic control system further includes a one or more signal receivers to receive one or more signals sent by the central control station.

In one embodiment, the one or more signals instruct the controller to switch to a second traffic schedule.

The present invention provides a method for of regulating traffic with a variable speed limit sign. The method includes: providing a variable speed limit sign synchronized using a first radio clock with a traffic control device synchronized with a second radio clock; determining the time before the traffic control device displays a stop signal; determining the variable speed that a vehicle should maintain to avoid the stop signal at the traffic control device; displaying the required speed for the vehicle to maintain to avoid the stop signal at the traffic control device; wherein the variable speed limit sign includes: a controller including: a first radio clock with an output to synchronize the controller with a traffic control device synchronized by a second radio clock, wherein the traffic control device is programmed with a predictable output schedule; a programmable memory device containing the timing sequence of the upcoming traffic control device and one or more traffic schedules; a processor for determining the variable speed limit for a vehicle to maintain to avoid a stop signal at the upcoming traffic control device; and a display operatively coupled to the controller for communicating the variable speed limit to the vehicle.

In one embodiment, the first and second radio clocks are synchronized by a time code bit stream transmitted by one or more radio transmitters, wherein the one or more radio transmitters are connected to a time standard.

In one embodiment, a second display output provides the speed that will provide a left hand turn or a right hand turn at the next traffic controller.

The present invention provides a traffic control system for merging traffic. The traffic control system including: a first variable speed limit sign including: a first controller including: a first radio clock with a first output to synchronize the first controller with a time standard; a first programmable memory device containing a first variable speed limit that places a first oncoming vehicle at the intersection of a first merging traffic lane and a second merging traffic lanes at a precise universal time with a precise velocity; a first display operatively coupled to the first controller for communicating the first variable speed limit to the first oncoming vehicle, wherein the first variable speed limit sign is proximate the first merging traffic lane; and a second variable speed limit sign including; a second controller including: a second radio clock with a second output to synchronize the second controller with the time standard; a second programmable memory device containing a second variable speed limit that places the second oncoming vehicle at the intersection of a first and a second merging traffic lanes at a precise universal time with a precise velocity to avoid colliding with the first oncoming vehicle; a second display operatively coupled to the second controller for communicating the second variable speed limit to the second oncoming vehicle, wherein the second variable speed limit sign is proximate a second merging traffic lane.

In one embodiment, the first and second radio clocks each independently include a clock that is synchronized by a time code bit stream transmitted by one or more radio transmitters each connected to a time standard, wherein the time standard is a radio controlled clock.

The present invention provides a method of merging traffic with two or more variable speed limit signs. The method includes: providing a first variable speed limit sign including: a first controller including: a first radio clock with a first output to synchronize the first controller with a time standard; a first programmable memory device containing a first variable speed limit that places a first oncoming vehicle at the intersection of a first merging traffic lane and a second merging traffic lanes at a precise universal time with a precise velocity; a first display operatively coupled to the first controller for communicating the first variable speed limit to the first oncoming vehicle, wherein the first variable speed limit sign is proximate the first merging traffic lane; providing a second variable speed limit sign including; a second controller including: a second radio clock with a second output to synchronize the second controller with the time standard; a second programmable memory device containing a second variable speed limit that places the second oncoming vehicle at the intersection of a first and a second merging traffic lanes at a precise universal time with a precise velocity to avoid colliding with the first oncoming vehicle; a second display operatively coupled to the second controller for communicating the second variable speed limit to the second oncoming vehicle, wherein the second variable speed limit sign is proximate a second merging traffic lane; displaying the first variable speed limit for a first oncoming vehicle on the first merging traffic lane to maintain to avoid colliding with a second oncoming vehicle in the second merging traffic lane in the intersection of the first merging traffic lane and the second merging traffic lane; and optionally displaying the second variable speed limit for a second oncoming vehicle on the second merging traffic lane to maintain to avoid colliding with a first oncoming vehicle in the first merging traffic lane in the intersection of the first merging traffic lane and the second merging traffic lane.

In one embodiment, the first and second radio clocks each independently include a clock that is synchronized by a time code bit stream transmitted by one or more radio transmitters each connected to a time standard, wherein the time standard is an atomic clock.

BRIEF DESCRIPTION OF THE DRAWINGS

Embodiments of the invention may be best understood by referring to the following description and accompanying drawings, which illustrate such embodiments. In the drawings.

Figure 1:
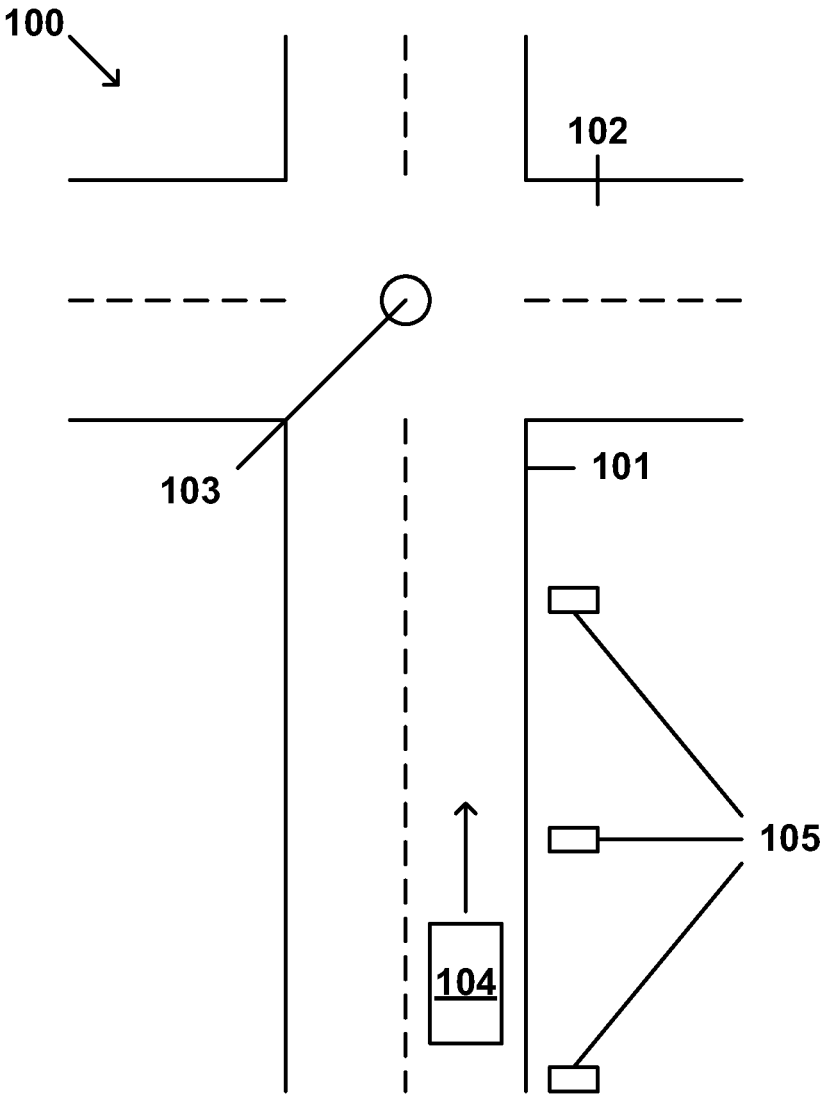
FIG. 1 is a plan view of an intersection equipped with an exemplary variable speed limit sign.

The drawings are not necessarily to scale. Like numbers used in the figures refer to like components, steps and the like. However, it will be understood that the use of a number to refer to a component in a given figure is not intended to limit the component in another figure labeled with the same number.

DETAILED DESCRIPTION OF THE INVENTION

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, Mass., 1993, and *The American Heritage Dictionary of the English Language*, Houghton Mifflin, Boston Mass., 1981.

The following explanations of certain terms are meant to be illustrative rather than exhaustive. These terms have their ordinary meanings given by usage in the art and in addition include the following explanations.

As used herein, the term "about" refers to a variation of 10 percent of the value specified; for example, about 50 percent carries a variation from 45 to 55 percent.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the terms "include," "for example," "such as," and the like are used illustratively and are not intended to limit the present invention.

As used herein, the term "oncoming" refers to a vehicle that is approaching a variable speed limit sign or a traffic control device.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element, which they describe, as the various elements may be oriented differently in various applications.

The present invention provides a variable speed limit sign that can be used in conjunction with a centrally controlled traffic control device to provide a traffic control system that can (1) reduce energy use by having vehicles avoid stopping at a traffic light, (2) reduce pollution by reducing energy use, (3) condition drivers to drive at the suggested speed by guaranteeing them a green light at the next intersection (4) make driving more pleasurable and safer by eliminating the uncertainty of making the next light, (5) eliminating the urge to speed to make the next light, (6) direct drivers drive in platoon fashion at the controlled intersections, arriving slightly after the light turns green, and exiting slightly before the light turns red, (7) create a simple, economical, and decentralized traffic system where each component is autonomous and reliable, (8) eliminate the annoying and dangerous cognitive dissonance that arises in the driver when the speed limit and the timing of lights are at odds with each other, and (9) reduce congestion by increasing traffic flow.

The present invention allows drivers, who obey displayed, variable speed signs, to drive through an urban area without stopping for traffic lights. The disclosure also teaches how to build an economical and reliable system that can be implemented without the expense and complexity wired communication or radio frequency devices, sensors, or reactive or interactive real time computer controlled systems. This disclosure also prescribes a precise, simple, minimally directive, intuitive system for drivers to follow. This disclosure teaches a means of guaranteeing drivers leaving one intersection, a green light at the next. This disclosure displays to all drivers passing, a single speed to drive to reach the next intersection in time for a scheduled green light. The speed displayed will result in all drivers converging in a target area, near the next traffic light controlled intersection, in platoon fashion, when the light turns green. This disclosure is not hindered by weather, hills, obstacles, or distance. The only thing the driver needs to learn is to follow the posted speed limit. By lessening the number of stops, driver's mileage will increase; they will be happier, they will drive the prescribed speed, emissions will fall, and traffic will move more smoothly through intersections, a given road will be able to carry more traffic.

By using variable speed signs and precise, programmed, predictable schedules based in universal time, as well as giving drivers a single precise speed to travel, drivers are more likely to follow the posted speed. This disclosure follows a simple repetitive pattern: (1) go through an intersection; (2) read the speed sign; (3) drive that speed; and (4) the next light will be green as you approach. Additionally, by using precise traffic light schedules, and variable speeds, it will be possible to program an entire grid so that cross traffic may move without encountering red lights. By giving the driver a guarantee of a green light at the next intersection, most rational people will simply drive that speed. Conversely, by not driving the posted speed, a driver is probably going to hit a red light, and thus will have an incentive not to speed above the displayed speed directive. By guaranteeing the driver of an upcoming green light—not having drivers worried about making the next light, drivers will become conditioned, remain calm, and drive predictably at legal speeds.

This disclosure uses precise programmed predictable schedules that are programmed and scheduled in universal time. As such, different traffic control jurisdictions can easily share scheduling information so that their traffic lights may be coordinated. By using such schedules a computer program will be able to model traffic flows in a grid, so that drivers can drive without stopping.

This disclosure does not require that the individual components communicate with each other. Each variable speed limit sign is a programmed, stand-alone unit that is autonomous from the traffic signals or other variable speed limit signs. Thus, a traffic control system that utilizes the variable speed limit sign is relatively simple, consumes little power, relatively tamperproof, economical, quickly installed, and robust. All that need be done is replace, or modify and reprogram existing computerized traffic light controllers. Then install specialized, stand alone, pre-programmed variable speed limit signs, with specialized controllers displaying the correct legal speed necessary to drive so as to make the next green light. This disclosure allows drivers, who obey displayed, variable speed signs, to drive through an urban area without stopping for traffic lights. This disclosure also teaches how to build an economical and reliable system that can be implemented without the expense and complexity wired communication or radio frequency devices, sensors, or reactive or interactive, real time computer controlled systems. This disclosure also prescribes a precise, simple, minimally directive, intuitive system for drivers to follow. The variable speed limit sign teaches a means of guaranteeing drivers leaving one intersection, a green light at the next. The variable speed limit sign displays to all drivers passing by it, a single speed to drive to reach the next intersection in time for a scheduled green light. The speed displayed will result in all drivers converging in a target area, near the next traffic light controlled intersection, in platoon fashion, when the light turns green. The variable speed limit sign is not hindered by weather, hills, obstacles, or distance. The only thing a driver needs to learn is to follow the posted speed limit. By lessening the number of stops, the driver's mileage will increase; the driver will be happier, the driver will drive the prescribed speed with reduced emissions, and traffic will move more smoothly through intersections, a given road will be able a higher load of vehicle traffic.

By using variable speed limit signs and precise, programmed, predictable schedules based in universal time, as well as giving drivers a single precise speed to travel, drivers are more likely to follow the posted speed. The driver will become condition to follow a simple repetitive pattern: go through an intersection; read the speed sign; drive that speed; and hit a green light. Additionally, by using precise traffic light schedules, and variable speeds, it will be possible to program an entire grid so that cross traffic may move without encountering red lights. By providing a green light at the next intersection, people will simply drive that speed. Contrarily, by not driving the posted speed, a driver is probably going to hit a red light, and thus will have an incentive not to speed above the displayed speed directive.

By using precise programmed predictable schedules, programmed and scheduled in universal time, differing traffic controlling jurisdictions can easily share scheduling information so that their traffic lights may be coordinated. By using these schedules, a computer program will be able to model traffic flows in a grid, and thereby assure that drivers can drive without stopping. This system is of low cost because none of the individual components communicate with each other in any way. They are stand-alone, programmed, and autonomous from each other. As such, this relatively simple, easy-to-install, and economical system consumes little power and is relatively tamperproof and robust. All that need be done is replace, modify, and/or reprogram the existing computerized traffic light controllers and install specialized, stand alone, pre-programmed variable speed limit signs, with specialized controllers displaying the correct legal speed necessary to drive to make the next green light.

To build a traffic control system utilizing the variable speed limit signs may be relatively straightforward. First, modify, reprogram, or replace the traffic light controllers so that their internal clocks are synched to Universal Time (i.e., UTC or UT), GMT (Greenwich mean time), or the equivalent with a radio synched WWVB based clock (i.e., an atomic clock), or other another clock synching means such as a GPS device. The controllers should be programmed to operate on a precise, predictable schedule based upon Universal Time and a calendar. Second, create specialized variable speed signs with a programmable controller that is similarly synched to the same clock as the traffic lights. Third, plan the placement of the variable speed limit signs. Typically, each controlled intersection would require at least four variable speed limit signs. Fourth, determine the distance of each sign from its corresponding traffic light. Fifth, program the variable speed signs so that they always give the proper legal speed in which to arrive at a target area near the corresponding intersection when the corresponding intersection's light is programmed to turn green. Sixth, place the signs in their predetermined spot. Seventh, institute a public education campaign consisting of media and helpful roadside signs to instruct drivers how to use the system. Eighth, deploy additional signage and devices to enhance the system including, for example, a sign instructing drivers who are obeying the prescribed speeds to turn on their emergency flashers or a radar speed sign that may help drivers determine if their speedometer is accurate.

The basis for this system is the highly accurate, synchronized clocks controlling the operation of the traffic lights and outlying programmed variable speed limit signs. Controllers can be kept synched using a WWVB based clock and calendar (atomic clock), GPS based clocks, or some other external clock resetting scheme. These systems can easily keep all of the variable speed limit signs' internal clocks within, plus or minus, one second of universal time or GMT. In contrast, internal clocks, for example, quartz, electro-mechanical, or real-time computer clocks are simply not accurate enough over a long period of time. For example, internal clocks drift and often gain or lose 30 seconds per month. As such, internal clocks will not allow the time critical, autonomous elements to function with the necessary accuracy.

If the traffic lights are strictly scheduled by time and date, then they are made absolutely predictable. For example, the eastbound light will turn green at 6:47 and 30 seconds on a given day. At 6:48 and zero seconds, the eastbound light will turn yellow; at 6:48 and 5 seconds, the eastbound light will turn red; at 6:48:35 the eastbound light will turn green again, etc. Therefore, very weekday at 6:47 and 30 seconds the eastbound light would be green. The entire year's schedule may be programmed in such a manner. By having certain and reliable traffic light schedules, the variable speed signs can be programmed to display the proper speed by time and date.

This predictable Universal Time schedule can also accommodate an "on demand" functioning if desired. For example, if the green light portion of the cycle is predictable, the other portions of the cycle may have "on demand" real time features as long as these flex periods are on fixed schedules and do not interfere with the fixed green light schedule.

If the traffic lights have an accurate, guaranteed, time and calendar based schedule, derived speeds can be programmed into autonomously functioning variable speed displays for any distance and any time. Thus, a driver will arrive, for example, four to ten seconds after a light turns green, or at a point that the driver can proceed safely through the green light. If desired, multiple displays may be placed along the route. This would be especially helpful on a highway approaching an intersection where several signs may be posted at intervals.

The variable speed limit signs will be pre-programmed with specific speeds; such that automobiles reach the corresponding intersection a determined distance or time after the light turns green. For example, five seconds after or a distance of two hundred feet before the light turns green. The variable speed limit sign may also be capable of communicating other messages relevant or instructive to drivers.

Various rules can be adapted for this type of driving. For example, a driver driving the posted speed may be instructed to drive with their emergency flashers on, showing that drivers are driving the correct speed. Thus, approaching vehicles or drivers turning onto a road will be visually informed of the proper speed to drive.

This disclosure differs from the prior art in many ways. For example, the present invention uniquely uses operant conditioning to control traffic. Drivers following displayed speeds are predictably rewarded by a green light at the next intersection. This removes or reduces cognitive dissonance from driving. In the prior art systems, drivers have mixed motives while driving. They want: to obey the speed limit, to make the next light, to be on time, and to drive with traffic. As a result, the prior art systems create tension while driving.

One of the dangers of the present system of timed traffic lights is traffic passing through an intersection at too high of speed, which can lead to accidents with other vehicles and pedestrians. With a system using variable speed limit signs, vehicle speeds through the intersection will be lower.

This disclosure may also be used in traffic grids. With fixed schedules and variable speed limits traffic can be effectively "shaped" into platoons of vehicles moving through the intersection. Further, compliance to the variable speed limit signs is likely to be very high because the driver can move faster with less stress. Also, once the vehicles are platooned and do not stop, more vehicles can pass through a given intersection during a given time period. Thus, shorter more accurate traffic light cycles and/or increase traffic volume can result.

Additionally, with the predictable scheduling and variable speed limit signs in all directions, platoons of vehicles will be timed such that opposing streams of traffic meet at an intersection at the same time, and thereby reduce the need for lengthy signal periods. For example, if a traffic light is green, cross traffic will be in transit at various speeds and may not meet while opposing streams of traffic always meet at the green lights. This described programming can be described as traffic shaping. Highly compliant and incentivized drivers will drive the posted speeds and be rewarded with a green light.

With strict fixed schedules and variable speed limits, cross jurisdiction coordination is also possible. Since county governments control some lights, state highway departments control other light, and municipal governments control still other lights, these entities can supply each other their light schedules or proposed schedules, and compensate to the new certain schedule. Traffic schedules may also be posted wiki style for anyone to view, comment upon, or synchronize their lights with them.

Another use of the system may be for freeway entrances and exits. While approaching a freeway exit or entrance the variable speed limit sign may read for example, "to avoid merging traffic drive 53 mph" while the merging traffic may be instructed to drive 60 mph. By using this method, gaps in merging lanes may be created so that the merging traffic may join the traffic stream in a temporarily empty lane. Additionally, the sign may read for example, "to make green light exit drive 57 mph" so that exiting vehicles will reach a green light at the end of the exit ramp.

Compared to the prior art, the present invention is counter-intuitive and radical. The system is not real-time controlled and lacks a central control. Also, there is not communication between the variable speed limit sign and the traffic control signal. As such, the system is robust, reliable, and cost effective.

This disclosure adds certainty and predictability to driving from the driver's perspective. This disclosure teaches a system that can be adopted by all drivers with no new equipment. This disclosure teaches a robust system that is unlikely to fail or go out of synchronicity over time or after a power failure. This disclosure teaches a system where variable speed limit signs can give accurate single speeds to follow in all weather, from any distance. The variable speed signs are unaffected by obstacles or geography. This disclosure teaches a system in which all parts are "dumb" and function independently. Therefore, the present invention is not susceptible to system wide failure, due to, for example, a centrally controlling computer failure. This disclosure teaches a highly synchronous system with highly autonomous parts. This disclosure teaches a system that encourages adherence to speed. This disclosure teaches a method of conditioning drivers by using a behavior/reward: the reward being a green light. This disclosure teaches a low cost approach to traffic management, needing only to: (1) modify all traffic controllers to be on universal time, (2) reprogram traffic controllers to fixed schedules, (3) acquire specially programmed, corresponding variable speed signs, and (4) place them at designated points approaching an intersection or on ramp.

FIG. 1 is a plan view of an intersection 100 equipped with one embodiment of the variable speed limit sign. The intersection 100 includes a first road 101 intersecting a second road 102. At the center of the intersection 100 is a traffic control device 103, typically a stop signal. As the vehicle 104 approaches the intersection 100, the driver will observe several variable speed limit signs 105 placed at certain distances along the first road 101. Each of the variable speed limit signs 105 will display a speed by which the vehicle 104 may travel to safely reach and traverse the controlled intersection without the need to stop at the intersection 100. Thus, the vehicle 104 would avoid waiting in line at intersection 100, as well as the idling of the engine that wastes fuel and increases pollution.

The traffic control device 103 may be a conventional traffic light with alternating color lights, for example, green for go, red for stop, and yellow for caution, and the like. The timing sequence of the traffic control device 103 is controlled by a central traffic control system.

Figure 2:
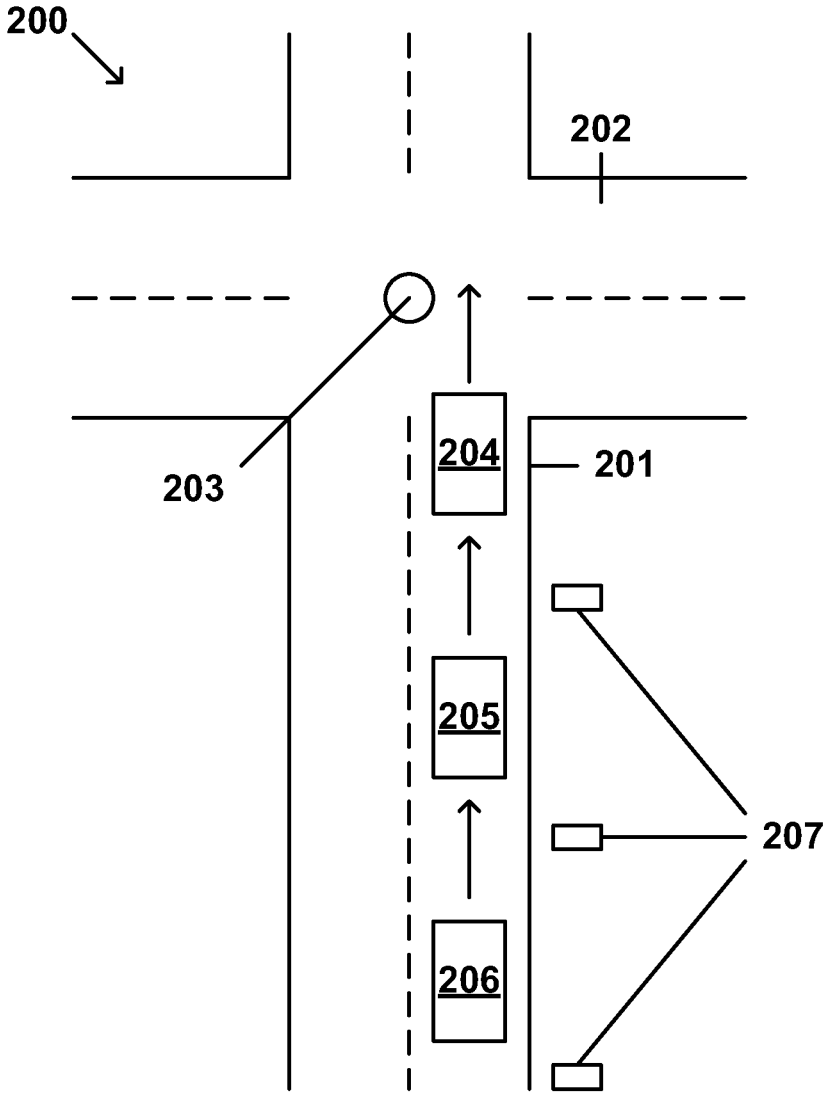
FIG. 2 is a plan view of an intersection equipped with an exemplary variable speed limit sign.

FIG. 2 is a plan view of an intersection 200 equipped with one embodiment of the variable speed limit sign. The intersection 200 includes a first road 201 intersecting a second road 202. At the center of the intersection 200 is a traffic control device 203, typically a stop signal. As the vehicles 204, 205, and 206 each approaches the intersection 200, the each driver will observe several variable speed limit signs 207 placed at certain distances along the first road 201. Each of the variable speed limit signs 207 will display a speed by which the each of the vehicles 204, 205, and 206 may travel to safely reach and traverse the controlled intersection without the need to stop at the intersection 200. Thus, each of the vehicles 204, 205, and 206 would avoid waiting in line at intersection 200, as well as the idling of the engine that wastes fuel and increases pollution.

The traffic control device 203 may be a conventional traffic light with alternating color lights, for example, green for go, red for stop, and yellow for caution, and the like. The timing sequence of the traffic control device 203 is controlled by a central traffic control system.

Figure 3:
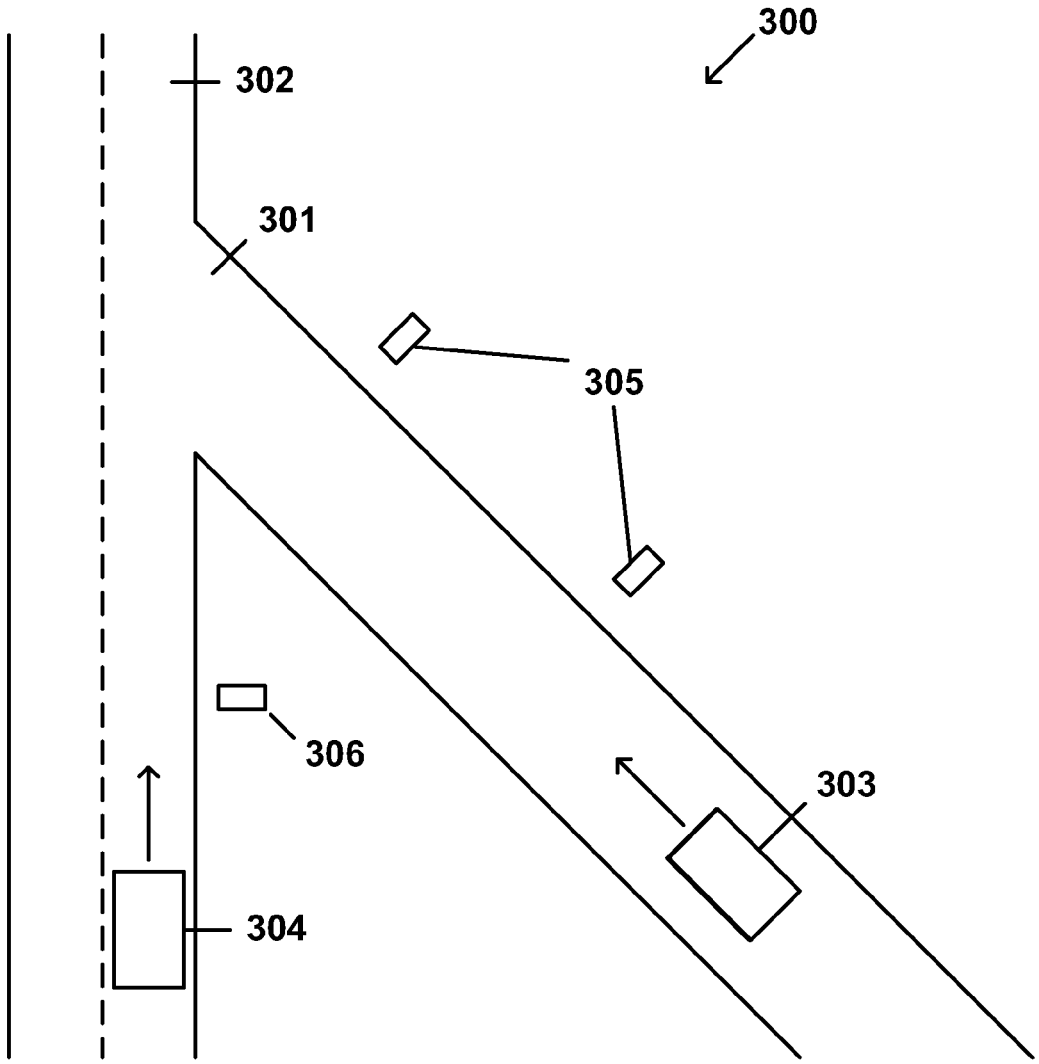
FIG. 3 is a plan view of an intersection equipped with an exemplary variable speed limit sign.

FIG. 3 is a plan view of an intersection 300 equipped with one embodiment of the variable speed limit sign. The intersection 300 includes a first road 301 merging into a second road 302, as found on, for example, an interstate highway. As the vehicles 303 and 304 each approach the intersection 300, the each driver will observe their respective variable speed limit signs 305 and 306 placed at certain distances along their respective roads 301 and 302. Each of the variable speed limit signs 305 and 306 will display a speed by which the each of the vehicles 303 and 304 may travel so that vehicle 303 safely merges into the second road 302.

Figures 4A, 4B, 4C:
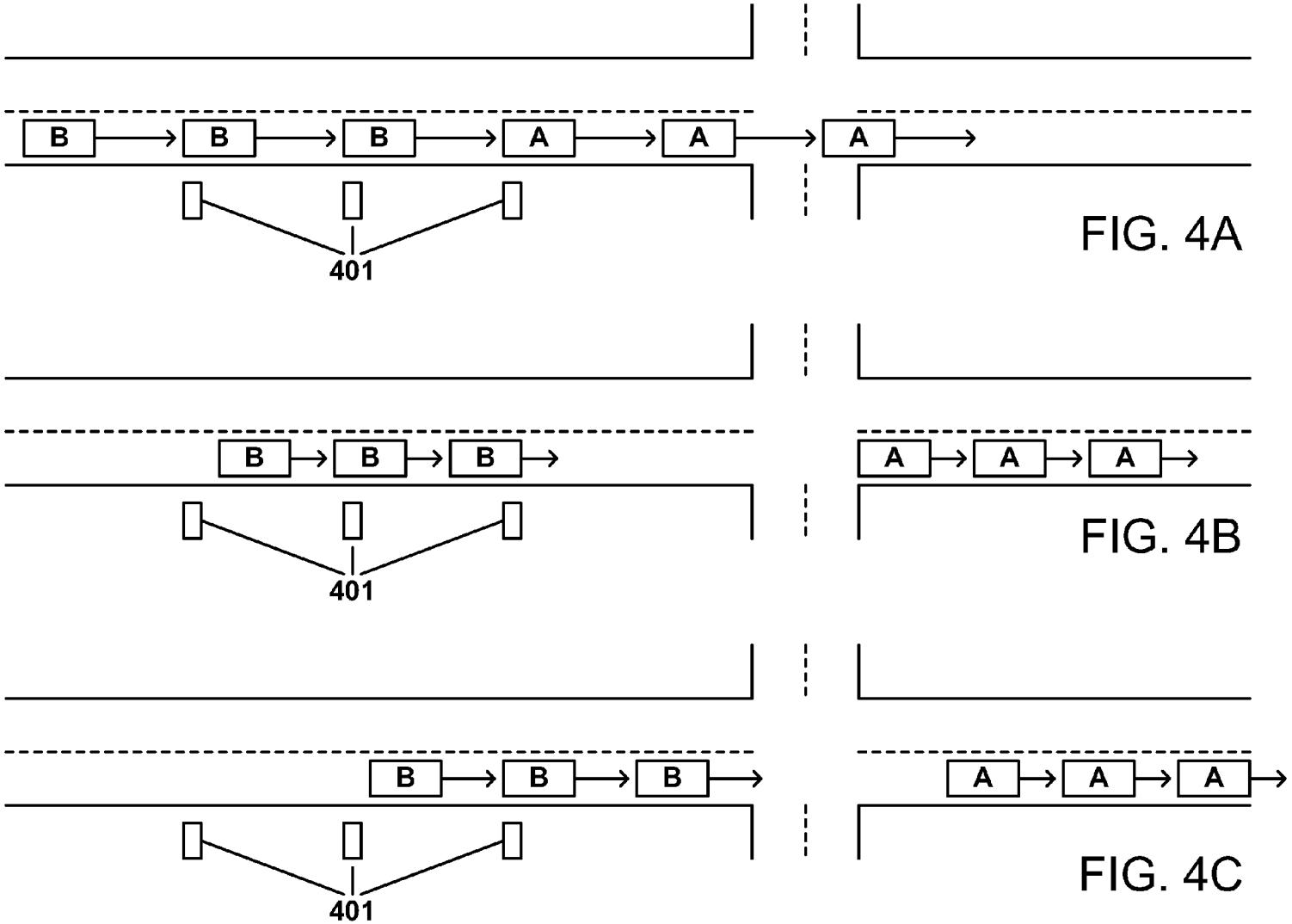
FIGS. 4A-C are plan views of an intersection equipped with an exemplary variable speed limit sign.

FIG. 4A illustrate the situation when vehicles approach an intersection. The relative magnitudes of the velocities of each vehicle are indicated by the magnitude of the corresponding vector. In FIG. 4A, two clusters of vehicles are identified as cluster A and cluster B, all traveling from left to right approaching the intersection prior to a red light. At some time during their approach, the vehicles are traveling at constant speed, and are located at varying distances from the intersection. Based on their distances to the intersection, and the speed of the vehicles, those vehicles in cluster A will pass through on the current green light cycle, and cluster B will be required by the variable speed limit sign 401 to slow down in anticipation of the light turning from green to red. In this manner, vehicles in cluster B continue moving but do not arrive at the intersection until the next green light.

FIG. 4B illustrates the vehicles at the intersection as the light changes to red. The vehicles closer to the intersection during the red condition will be slowed more than vehicles more distant. Thus as time elapses the vehicles tend to cluster into groups. The vehicles in cluster B are shown grouped together and traveling at the ideal speed to avoid stopping at the light. It should be appreciated that while the traffic control device is green, the group of vehicles that can safely traverse the intersection will be instructed by the variable speed limit sign 401 to travel at a certain speed and may be allowed to accelerate up to or even beyond the speed limit to optimize the spacing and speed of the group relative to other groups fore and aft. Therefore, the vehicles in cluster A are shown after having passed through the intersection, grouped together closely and traveling at the same speed.

FIG. 4C illustrate the intersection as the light turns green. Cluster A is continuing on beyond the intersection, and cluster B has reached the intersection, and is accelerating as a group, back up to the normal speed of traffic on the road.

Table 1 below illustrates a typical traffic schedule for vehicles approaching a traffic light at about thirty miles per hour with variable speed limit signs spaced about 3000 feet from the traffic light. Column 1 shows the schedule of the traffic light. Column 2 shows the color of the traffic light. Column 3 shows the go and stop periods. Column 4 shows the time the vehicle passed the variable speed limit sign. For example, if a vehicle passes the variable speed limit sign at about 8:00:23 (i.e., hours:minutes:seconds) at about 30 mph (44 feet per second), the vehicle would arrive at the traffic light in about 68 seconds [3000 feet÷5260 feet/mile~0.57 mile; 0.57 mile÷(0.5 mile/60 seconds)~about 68 seconds] or at about 8:01:31. According to the light schedule, the vehicle would arrive at a red light and have to stop, which is undesirable. As a result, the vehicle is directed to the next Go period at about 8:02:06. To arrive at that time, the vehicle would have to drive about 19 MPH.

For safety and traffic flow reasons, it is better for the vehicle to arrive after the light turns green so as to clear the intersection. Additionally, it is desirable for the vehicle to exit the intersection prior to the light turning red. Therefore, the Go period is embedded into the green light portion of the traffic signal's schedule. In this case, the green and yellow portion of the signal is 30 seconds. The Go period is twenty seconds, leaving five seconds after the light turns green and five seconds before the light turns red. The Go period is the target period for the pacing the vehicles and setting the vehicle's speed limits. In this example, the Go period is between 8:02:06 and 8:02:25 inclusive.

Table 2 below illustrates an alternate traffic schedule for vehicles approaching a traffic light at sixty miles per hour with variable speed limit signs spaced about 1 mile from the traffic light with staggered arrival times.

In one embodiment, each of the one or more traffic schedules has a different maximum speed. In one embodiment, each of the one or more traffic schedules has a maximum speed from about 5 miles per hour to about 75 miles hour.

In one embodiment, one of the one or more traffic schedules has a maximum speed of about 5 miles per hour. In one embodiment, one of the one or more traffic schedules has a maximum speed of about 10 miles per hour. In one embodiment, one of the one or more traffic schedules has a maximum speed of about 15 miles per hour. In one embodiment, one of the one or more traffic schedules has a maximum speed of about 20 miles per hour.

In one embodiment, one of the one or more traffic schedules has a maximum speed of about 25 miles per hour. In one embodiment, one of the one or more traffic schedules has a maximum speed of about 30 miles per hour. In one embodiment, one of the one or more traffic schedules has a maximum speed of about 35 miles per hour. In one embodiment, one of the one or more traffic schedules has a maximum speed of about 40 miles per hour. In one embodiment, one of the one or more traffic schedules has a maximum speed of about 45 miles per hour.

In one embodiment, one of the one or more traffic schedules has a maximum speed of about 50 miles per hour. In one embodiment, one of the one or more traffic schedules has a maximum speed of about 55 miles per hour. In one embodiment, one of the one or more traffic schedules has a maximum speed of about 60 miles per hour. In one embodiment, one of the one or more traffic schedules has a maximum speed of about 65 miles per hour.

In one embodiment, the variable speed limit signal may be preprogrammed with one of the one or more traffic schedules. In one embodiment, each of the one of the one or more traffic schedules may be specific for a particular time of the year. In one embodiment, one of the one or more traffic schedules may be preprogrammed for winter driving conditions. In one embodiment, one of the one or more traffic schedules may be preprogrammed for spring driving conditions. In one embodiment, one of the one or more traffic schedules may be preprogrammed for summer driving conditions. In one embodiment, one of the one or more traffic schedules may be preprogrammed for fall driving conditions.

In one embodiment, one of the one or more traffic schedules may be preprogrammed for dry driving conditions. In one embodiment, one of the one or more traffic schedules may be preprogrammed for wet driving conditions. In one embodiment, one of the one or more traffic schedules may be preprogrammed for icy driving conditions. In one embodiment, one of the one or more traffic schedules may be preprogrammed for snowy driving conditions.

In one embodiment, one of the one or more traffic schedules may be preprogrammed for daytime driving conditions. In one embodiment, one of the one or more traffic schedules may be preprogrammed for nighttime driving conditions. In one embodiment, one of the one or more traffic schedules may be preprogrammed for dusk driving conditions. In one embodiment, one of the one or more traffic schedules may be preprogrammed for dawn driving conditions.

In one embodiment, the variable speed limit signal further includes a light sensor to detect the amount of daylight. In one embodiment, the variable speed limit signal further includes a smoke sensor to detect the amount of smoke. In one embodiment, the variable speed limit signal further includes a rain sensor to detect the amount of rain. In one embodiment, the variable speed limit signal further includes an ice sensor to detect the amount of ice. In one embodiment, the variable speed limit signal further includes a snow sensor to detect the amount of snow.

In one embodiment, one of the one or more signals may be a localized emergency signal. In one embodiment, one of the one or more signals may be a national emergency signal.

In one embodiment, each of the one or more traffic schedules delivers the vehicle to the traffic control device with a green light.

TABLE 1

Sample Traffic Control and Variable Speed Limit Sign Schedule with Speed Limit of 30 MPH

| Schedule of Traffic Light (Hours:Minutes:Seconds) | Color of Traffic Light At Scheduled Time | Go and Stop Periods for Entering and Exiting the Intersection | Time Vehicle Passed Variable Speed Limit Sign | Time Needed to Travel 3000 feet to Hit Target Zone (Seconds) | Speed in Feet per Second | Displayed Speed on Variable Speed Limit Sign in Miles/per hour | Time Vehicle hits Target Area near Traffic Controller |
|---|---|---|---|---|---|---|---|
| 8:01:26 | Yellow light | No-Go | 8:00:18 | 108 | 27.78 | 18.9 | 8:02:06 |
| 8:01:27 | Yellow light | No-Go | 8:00:19 | 107 | 28.04 | 19.1 | 8:02:06 |
| 8:01:28 | Yellow light | No-Go | 8:00:20 | 106 | 28.30 | 19.3 | 8:02:06 |
| 8:01:29 | Yellow light | No-Go | 8:00:21 | 105 | 28.57 | 19.5 | 8:02:06 |
| 8:01:30 | Yellow light | No-Go | 8:00:22 | 104 | 28.85 | 19.7 | 8:02:06 |
| 8:01:31 | Red Light | No-Go | 8:00:23 | 103 | 29.13 | 19.9 | 8:02:06 |
| 8:01:32 | Red Light | No-Go | 8:00:24 | 102 | 29.41 | 20.1 | 8:02:06 |
| 8:01:33 | Red Light | No-Go | 8:00:25 | 101 | 29.70 | 20.3 | 8:02:06 |
| 8:01:34 | Red Light | No-Go | 8:00:26 | 100 | 30.00 | 20.5 | 8:02:06 |
| 8:01:35 | Red Light | No-Go | 8:00:27 | 99 | 30.30 | 20.7 | 8:02:06 |
| 8:01:36 | Red Light | No-Go | 8:00:28 | 98 | 30.61 | 20.9 | 8:02:06 |
| 8:01:37 | Red Light | No-Go | 8:00:29 | 97 | 30.93 | 21.1 | 8:02:06 |
| 8:01:38 | Red Light | No-Go | 8:00:30 | 96 | 31.25 | 21.3 | 8:02:06 |
| 8:01:39 | Red Light | No-Go | 8:00:31 | 95 | 31.58 | 21.5 | 8:02:06 |
| 8:01:40 | Red Light | No-Go | 8:00:32 | 94 | 31.91 | 21.8 | 8:02:06 |
| 8:01:41 | Red Light | No-Go | 8:00:33 | 93 | 32.26 | 22.0 | 8:02:06 |
| 8:01:42 | Red Light | No-Go | 8:00:34 | 92 | 32.61 | 22.2 | 8:02:06 |
| 8:01:43 | Red Light | No-Go | 8:00:35 | 91 | 32.97 | 22.5 | 8:02:06 |
| 8:01:44 | Red Light | No-Go | 8:00:36 | 90 | 33.33 | 22.7 | 8:02:06 |
| 8:01:45 | Red Light | No-Go | 8:00:37 | 89 | 33.71 | 23.0 | 8:02:06 |
| 8:01:46 | Red Light | No-Go | 8:00:38 | 88 | 34.09 | 23.2 | 8:02:06 |
| 8:01:47 | Red Light | No-Go | 8:00:39 | 87 | 34.48 | 23.5 | 8:02:06 |
| 8:01:48 | Red Light | No-Go | 8:00:40 | 86 | 34.88 | 23.8 | 8:02:06 |
| 8:01:49 | Red Light | No-Go | 8:00:41 | 85 | 35.29 | 24.1 | 8:02:06 |
| 8:01:50 | Red Light | No-Go | 8:00:42 | 84 | 35.71 | 24.4 | 8:02:06 |
| 8:01:51 | Red Light | No-Go | 8:00:43 | 83 | 36.14 | 24.6 | 8:02:06 |
| 8:01:52 | Red Light | No-Go | 8:00:44 | 82 | 36.59 | 24.9 | 8:02:06 |
| 8:01:53 | Red Light | No-Go | 8:00:45 | 81 | 37.04 | 25.3 | 8:02:06 |
| 8:01:54 | Red Light | No-Go | 8:00:46 | 80 | 37.50 | 25.6 | 8:02:06 |
| 8:01:55 | Red Light | No-Go | 8:00:47 | 79 | 37.97 | 25.9 | 8:02:06 |
| 8:01:56 | Red Light | No-Go | 8:00:48 | 78 | 38.46 | 26.2 | 8:02:06 |
| 8:01:57 | Red Light | No-Go | 8:00:49 | 77 | 38.96 | 26.6 | 8:02:06 |
| 8:01:58 | Red Light | No-Go | 8:00:50 | 76 | 39.47 | 26.9 | 8:02:06 |
| 8:01:59 | Red Light | No-Go | 8:00:51 | 75 | 40.00 | 27.3 | 8:02:06 |
| 8:02:00 | Red Light | No-Go | 8:00:52 | 74 | 40.54 | 27.6 | 8:02:06 |
| 8:02:01 | Green Light | No-Go | 8:00:53 | 73 | 41.10 | 28.0 | 8:02:06 |
| 8:02:02 | Green Light | No-Go | 8:00:54 | 72 | 41.67 | 28.4 | 8:02:06 |
| 8:02:03 | Green Light | No-Go | 8:00:55 | 71 | 42.25 | 28.8 | 8:02:06 |
| 8:02:04 | Green Light | No-Go | 8:00:56 | 70 | 42.86 | 29.2 | 8:02:06 |
| 8:02:05 | Green Light | No-Go | 8:00:57 | 69 | 43.48 | 29.6 | 8:02:06 |
| 8:02:06 | Green Light | Target period | 8:00:58 | 68 | 44.00 | 30 | 8:02:06 |
| 8:02:07 | Green Light | Target period | 8:00:59 | 68 | 44.00 | 30 | 8:02:07 |
| 8:02:08 | Green Light | Target period | 8:01:00 | 68 | 44.00 | 30 | 8:02:08 |
| 8:02:09 | Green Light | Target period | 8:01:01 | 68 | 44.00 | 30 | 8:02:09 |
| 8:02:10 | Green Light | Target period | 8:01:02 | 68 | 44.00 | 30 | 8:02:10 |
| 8:02:11 | Green Light | Target period | 8:01:03 | 68 | 44.00 | 30 | 8:02:11 |
| 8:02:12 | Green Light | Target period | 8:01:04 | 68 | 44.00 | 30 | 8:02:12 |
| 8:02:13 | Green Light | Target period | 8:01:05 | 68 | 44.00 | 30 | 8:02:13 |
| 8:02:14 | Green Light | Target period | 8:01:06 | 68 | 44.00 | 30 | 8:02:14 |
| 8:02:15 | Green Light | Target period | 8:01:07 | 68 | 44.00 | 30 | 8:02:15 |
| 8:02:16 | Green Light | Target period | 8:01:08 | 68 | 44.00 | 30 | 8:02:16 |
| 8:02:17 | Green Light | Target period | 8:01:09 | 68 | 44.00 | 30 | 8:02:17 |
| 8:02:18 | Green Light | Target period | 8:01:10 | 68 | 44.00 | 30 | 8:02:18 |
| 8:02:19 | Green Light | Target period | 8:01:11 | 68 | 44.00 | 30 | 8:02:19 |
| 8:02:20 | Green Light | Target period | 8:01:12 | 68 | 44.00 | 30 | 8:02:20 |
| 8:02:21 | Green Light | Target period | 8:01:13 | 68 | 44.00 | 30 | 8:02:21 |
| 8:02:22 | Green Light | Target period | 8:01:14 | 68 | 44.00 | 30 | 8:02:22 |
| 8:02:23 | Green Light | Target period | 8:01:15 | 68 | 44.00 | 30 | 8:02:23 |
| 8:02:24 | Green Light | Target period | 8:01:16 | 68 | 44.00 | 30 | 8:02:24 |
| 8:02:25 | Green Light | Target period | 8:01:17 | 68 | 44.00 | 30 | 8:02:25 |
| 8:02:26 | Yellow light | No-Go | 8:01:18 | 108 | 27.78 | 18.9 | 8:03:06 |
| 8:02:27 | Yellow light | No-Go | 8:01:19 | 107 | 28.04 | 19.1 | 8:03:06 |
| 8:02:28 | Yellow light | No-Go | 8:01:20 | 106 | 28.30 | 19.3 | 8:03:06 |
| 8:02:29 | Yellow light | No-Go | 8:01:21 | 105 | 28.57 | 19.5 | 8:03:06 |
| 8:02:30 | Yellow light | No-Go | 8:01:22 | 104 | 28.85 | 19.7 | 8:03:06 |
| 8:02:31 | Red Light | No-Go | 8:01:23 | 103 | 29.13 | 19.9 | 8:03:06 |
| 8:02:32 | Red Light | No-Go | 8:01:24 | 102 | 29.41 | 20.1 | 8:03:06 |
| 8:02:33 | Red Light | No-Go | 8:01:25 | 101 | 29.70 | 20.3 | 8:03:06 |
| 8:02:34 | Red Light | No-Go | 8:01:26 | 100 | 30.00 | 20.5 | 8:03:06 |
| 8:02:35 | Red Light | No-Go | 8:01:27 | 99 | 30.30 | 20.7 | 8:03:06 |
| 8:02:36 | Red Light | No-Go | 8:01:28 | 98 | 30.61 | 20.9 | 8:03:06 |
| 8:02:37 | Red Light | No-Go | 8:01:29 | 97 | 30.93 | 21.1 | 8:03:06 |

TABLE 1-continued

Sample Traffic Control and Variable Speed Limit Sign Schedule with Speed Limit of 30 MPH

| Schedule of Traffic Light (Hours:Minutes:Seconds) | Color of Traffic Light At Scheduled Time | Go and Stop Periods for Entering and Exiting the Intersection | Time Vehicle Passed Variable Speed Limit Sign | Time Needed to Travel 3000 feet to Hit Target Zone (Seconds) | Speed in Feet per Second | Displayed Speed on Variable Speed Limit Sign in Miles/per hour | Time Vehicle hits Target Area near Traffic Controller |
|---|---|---|---|---|---|---|---|
| 8:02:38 | Red Light | No-Go | 8:01:30 | 96 | 31.25 | 21.3 | 8:03:06 |
| 8:02:39 | Red Light | No-Go | 8:01:31 | 95 | 31.58 | 21.5 | 8:03:06 |
| 8:02:40 | Red Light | No-Go | 8:01:32 | 94 | 31.91 | 21.8 | 8:03:06 |
| 8:02:41 | Red Light | No-Go | 8:01:33 | 93 | 32.26 | 22.0 | 8:03:06 |
| 8:02:42 | Red Light | No-Go | 8:01:34 | 92 | 32.61 | 22.2 | 8:03:06 |
| 8:02:43 | Red Light | No-Go | 8:01:35 | 91 | 32.97 | 22.5 | 8:03:06 |
| 8:02:44 | Red Light | No-Go | 8:01:36 | 90 | 33.33 | 22.7 | 8:03:06 |
| 8:02:45 | Red Light | No-Go | 8:01:37 | 89 | 33.71 | 23.0 | 8:03:06 |
| 8:02:46 | Red Light | No-Go | 8:01:38 | 88 | 34.09 | 23.2 | 8:03:06 |
| 8:02:47 | Red Light | No-Go | 8:01:39 | 87 | 34.48 | 23.5 | 8:03:06 |
| 8:02:48 | Red Light | No-Go | 8:01:40 | 86 | 34.88 | 23.8 | 8:03:06 |
| 8:02:49 | Red Light | No-Go | 8:01:41 | 85 | 35.29 | 24.1 | 8:03:06 |
| 8:02:50 | Red Light | No-Go | 8:01:42 | 84 | 35.71 | 24.4 | 8:03:06 |
| 8:02:51 | Red Light | No-Go | 8:01:43 | 83 | 36.14 | 24.6 | 8:03:06 |
| 8:02:52 | Red Light | No-Go | 8:01:44 | 82 | 36.59 | 24.9 | 8:03:06 |
| 8:02:53 | Red Light | No-Go | 8:01:45 | 81 | 37.04 | 25.3 | 8:03:06 |
| 8:02:54 | Red Light | No-Go | 8:01:46 | 80 | 37.50 | 25.6 | 8:03:06 |
| 8:02:55 | Red Light | No-Go | 8:01:47 | 79 | 37.97 | 25.9 | 8:03:06 |
| 8:02:56 | Red Light | No-Go | 8:01:48 | 78 | 38.46 | 26.2 | 8:03:06 |
| 8:02:57 | Red Light | No-Go | 8:01:49 | 77 | 38.96 | 26.6 | 8:03:06 |
| 8:02:58 | Red Light | No-Go | 8:01:50 | 76 | 39.47 | 26.9 | 8:03:06 |
| 8:02:59 | Red Light | No-Go | 8:01:51 | 75 | 40.00 | 27.3 | 8:03:06 |

TABLE 2

Alternate Traffic Control and Variable Speed Limit Sign Schedule with Speed Limit of 30 MPH with Staggered Arrival Times

| Schedule of Traffic Light (Hours:Minutes:Seconds) | Color of Traffic Light At Scheduled Time | Go and Stop Periods for Entering and Exiting the Intersection | Time Vehicle Passed Variable Speed Limit Sign | Time Needed to Travel 3000 feet to Hit Target Zone (Seconds) | Speed in Feet per Second | Displayed Speed on Variable Speed Limit Sign in Miles/per hour | Time Vehicle hits Target Area near Traffic Controller |
|---|---|---|---|---|---|---|---|
| 8:01:26 | Yellow light | No-Go | 8:00:18 | 108.0 | 27.78 | 18.9 | 8:02:06.0 |
| 8:01:27 | Yellow light | No-Go | 8:00:19 | 107.3 | 27.95 | 19.1 | 8:02:06.3 |
| 8:01:28 | Yellow light | No-Go | 8:00:20 | 106.6 | 28.13 | 19.3 | 8:02:06.6 |
| 8:01:29 | Yellow light | No-Go | 8:00:21 | 106.0 | 28.31 | 19.4 | 8:02:07.0 |
| 8:01:30 | Yellow light | No-Go | 8:00:22 | 105.3 | 28.49 | 19.6 | 8:02:07.3 |
| 8:01:31 | Red Light | No-Go | 8:00:23 | 104.6 | 28.68 | 19.8 | 8:02:07.6 |
| 8:01:32 | Red Light | No-Go | 8:00:24 | 103.9 | 28.86 | 20.0 | 8:02:07.9 |
| 8:01:33 | Red Light | No-Go | 8:00:25 | 103.3 | 29.05 | 20.2 | 8:02:08.3 |
| 8:01:34 | Red Light | No-Go | 8:00:26 | 102.6 | 29.25 | 20.4 | 8:02:08.6 |
| 8:01:35 | Red Light | No-Go | 8:00:27 | 101.9 | 29.44 | 20.6 | 8:02:08.9 |
| 8:01:36 | Red Light | No-Go | 8:00:28 | 101.2 | 29.64 | 20.8 | 8:02:09.2 |
| 8:01:37 | Red Light | No-Go | 8:00:29 | 100.5 | 29.84 | 21.0 | 8:02:09.5 |
| 8:01:38 | Red Light | No-Go | 8:00:30 | 99.9 | 30.04 | 21.1 | 8:02:09.9 |
| 8:01:39 | Red Light | No-Go | 8:00:31 | 99.2 | 30.25 | 21.3 | 8:02:10.2 |
| 8:01:40 | Red Light | No-Go | 8:00:32 | 98.5 | 30.45 | 21.5 | 8:02:10.5 |
| 8:01:41 | Red Light | No-Go | 8:00:33 | 97.8 | 30.67 | 21.7 | 8:02:10.8 |
| 8:01:42 | Red Light | No-Go | 8:00:34 | 97.2 | 30.88 | 21.9 | 8:02:11.2 |
| 8:01:43 | Red Light | No-Go | 8:00:35 | 96.5 | 31.10 | 22.1 | 8:02:11.5 |
| 8:01:44 | Red Light | No-Go | 8:00:36 | 95.8 | 31.32 | 22.3 | 8:02:11.8 |
| 8:01:45 | Red Light | No-Go | 8:00:37 | 95.1 | 31.54 | 22.5 | 8:02:12.1 |
| 8:01:46 | Red Light | No-Go | 8:00:38 | 94.4 | 31.77 | 22.7 | 8:02:12.4 |
| 8:01:47 | Red Light | No-Go | 8:00:39 | 93.8 | 32.00 | 22.9 | 8:02:12.8 |
| 8:01:48 | Red Light | No-Go | 8:00:40 | 93.1 | 32.23 | 23.0 | 8:02:13.1 |
| 8:01:49 | Red Light | No-Go | 8:00:41 | 92.4 | 32.47 | 23.2 | 8:02:13.4 |
| 8:01:50 | Red Light | No-Go | 8:00:42 | 91.7 | 32.71 | 23.4 | 8:02:13.7 |
| 8:01:51 | Red Light | No-Go | 8:00:43 | 91.1 | 32.95 | 23.6 | 8:02:14.1 |
| 8:01:52 | Red Light | No-Go | 8:00:44 | 90.4 | 33.20 | 23.8 | 8:02:14.4 |
| 8:01:53 | Red Light | No-Go | 8:00:45 | 89.7 | 33.45 | 24.0 | 8:02:14.7 |
| 8:01:54 | Red Light | No-Go | 8:00:46 | 89.0 | 33.70 | 24.2 | 8:02:15.0 |
| 8:01:55 | Red Light | No-Go | 8:00:47 | 88.3 | 33.96 | 24.4 | 8:02:15.3 |
| 8:01:56 | Red Light | No-Go | 8:00:48 | 87.7 | 34.22 | 24.6 | 8:02:15.7 |
| 8:01:57 | Red Light | No-Go | 8:00:49 | 87.0 | 34.49 | 24.8 | 8:02:16.0 |
| 8:01:58 | Red Light | No-Go | 8:00:50 | 86.3 | 34.76 | 24.9 | 8:02:16.3 |
| 8:01:59 | Red Light | No-Go | 8:00:51 | 85.6 | 35.04 | 25.1 | 8:02:16.6 |
| 8:02:00 | Red Light | No-Go | 8:00:52 | 84.9 | 35.32 | 25.3 | 8:02:16.9 |
| 8:02:01 | Green Light | No-Go | 8:00:53 | 84.3 | 35.60 | 25.5 | 8:02:17.3 |

TABLE 2-continued

Alternate Traffic Control and Variable Speed Limit Sign Schedule with Speed Limit of 30 MPH with Staggered Arrival Times

| Schedule of Traffic Light (Hours:Minutes:Seconds) | Color of Traffic Light At Scheduled Time | Go and Stop Periods for Entering and Exiting the Intersection | Time Vehicle Passed Variable Speed Limit Sign | Time Needed to Travel 3000 feet to Hit Target Zone (Seconds) | Speed in Feet per Second | Displayed Speed on Variable Speed Limit Sign in Miles/per hour | Time Vehicle hits Target Area near Traffic Controller |
|---|---|---|---|---|---|---|---|
| 8:02:02 | Green Light | No-Go | 8:00:54 | 83.6 | 35.89 | 25.7 | 8:02:17.6 |
| 8:02:03 | Green Light | No-Go | 8:00:55 | 82.9 | 36.18 | 25.9 | 8:02:17.9 |
| 8:02:04 | Green Light | No-Go | 8:00:56 | 82.2 | 36.48 | 26.1 | 8:02:18.2 |
| 8:02:05 | Green Light | No-Go | 8:00:57 | 81.6 | 36.78 | 26.3 | 8:02:18.6 |
| 8:02:06 | Green Light | Target period | 8:00:58 | 80.9 | 37.09 | 26.5 | 8:02:18.9 |
| 8:02:07 | Green Light | Target period | 8:00:59 | 80.2 | 37.40 | 26.7 | 8:02:19.2 |
| 8:02:08 | Green Light | Target period | 8:01:00 | 79.5 | 37.72 | 26.8 | 8:02:19.5 |
| 8:02:09 | Green Light | Target period | 8:01:01 | 78.8 | 38.05 | 27.0 | 8:02:19.8 |
| 8:02:10 | Green Light | Target period | 8:01:02 | 78.2 | 38.38 | 27.2 | 8:02:20.2 |
| 8:02:11 | Green Light | Target period | 8:01:03 | 77.5 | 38.71 | 27.4 | 8:02:20.5 |
| 8:02:12 | Green Light | Target period | 8:01:04 | 76.8 | 39.06 | 27.6 | 8:02:20.8 |
| 8:02:13 | Green Light | Target period | 8:01:05 | 76.1 | 39.40 | 27.8 | 8:02:21.1 |
| 8:02:14 | Green Light | Target period | 8:01:06 | 75.5 | 39.76 | 28.0 | 8:02:21.5 |
| 8:02:15 | Green Light | Target period | 8:01:07 | 74.8 | 40.12 | 28.2 | 8:02:21.8 |
| 8:02:16 | Green Light | Target period | 8:01:08 | 74.1 | 40.48 | 28.4 | 8:02:22.1 |
| 8:02:17 | Green Light | Target period | 8:01:09 | 73.4 | 40.86 | 28.6 | 8:02:22.4 |
| 8:02:18 | Green Light | Target period | 8:01:10 | 72.7 | 41.24 | 28.7 | 8:02:22.7 |
| 8:02:19 | Green Light | Target period | 8:01:11 | 72.1 | 41.63 | 28.9 | 8:02:23.1 |
| 8:02:20 | Green Light | Target period | 8:01:12 | 71.4 | 42.02 | 29.1 | 8:02:23.4 |
| 8:02:21 | Green Light | Target period | 8:01:13 | 70.7 | 42.43 | 29.3 | 8:02:23.7 |
| 8:02:22 | Green Light | Target period | 8:01:14 | 70.0 | 42.84 | 29.5 | 8:02:24.0 |
| 8:02:23 | Green Light | Target period | 8:01:15 | 69.4 | 43.26 | 29.7 | 8:02:24.4 |
| 8:02:24 | Green Light | Target period | 8:01:16 | 68.7 | 43.68 | 29.9 | 8:02:24.7 |
| 8:02:25 | Green Light | Target period | 8:01:17 | 68.0 | 44.12 | 30.1 | 8:02:25.0 |

Figure 5:
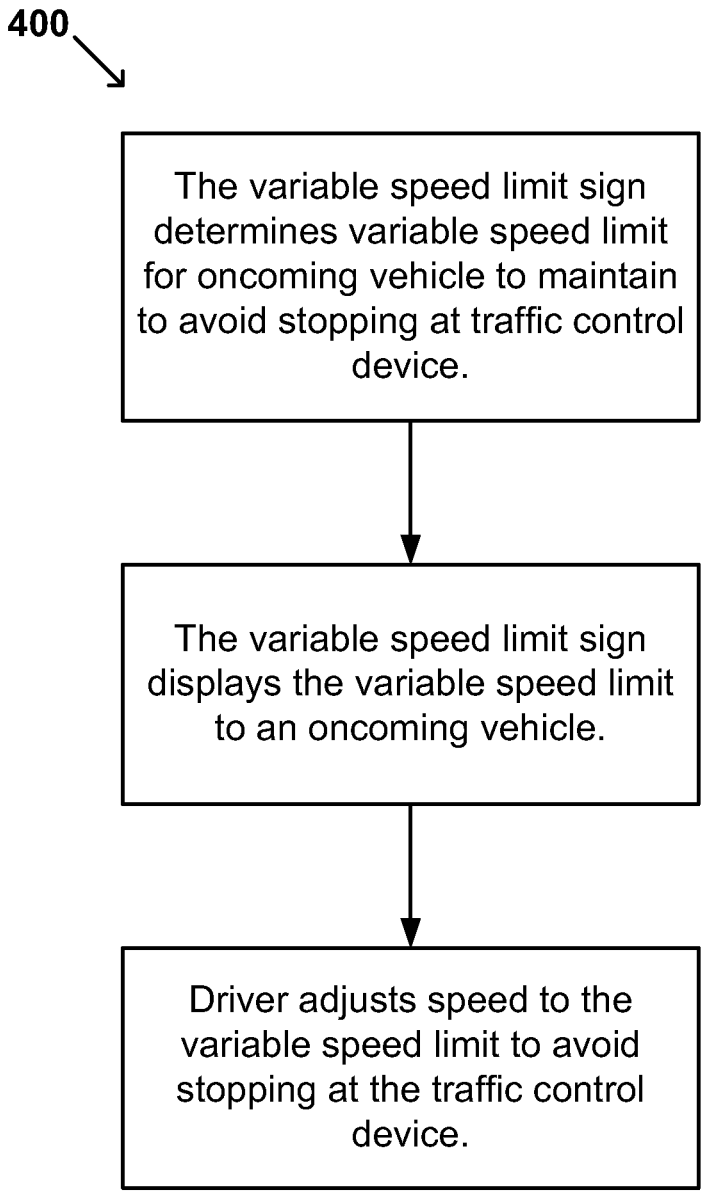
FIG. 5 is a block diagram illustrating an exemplary method of regulating traffic with an exemplary variable speed limit sign.

FIG. 5 is a block diagram illustrating an exemplary method 400 of regulating traffic with an exemplary variable speed limit sign. In this method, the variable speed limit sign determines variable speed limit for oncoming vehicle to maintain to avoid stopping at traffic control device. The variable speed limit sign displays the variable speed limit to an oncoming vehicle. The driver adjusts speed to the variable speed limit to avoid stopping at the traffic control device.

In the claims provided herein, the steps specified to be taken in a claimed method or process may be carried out in any order without departing from the principles of the invention, except when a temporal or operational sequence is explicitly defined by claim language. Recitation in a claim to the effect that first a step is performed then several other steps are performed shall be taken to mean that the first step is performed before any of the other steps, but the other steps may be performed in any sequence unless a sequence is further specified within the other steps. For example, claim elements that recite "first A, then B, C, and D, and lastly E" shall be construed to mean step A must be first, step E must be last, but steps B, C, and D may be carried out in any sequence between steps A and E and the process of that sequence will still fall within the four corners of the claim.

Furthermore, in the claims provided herein, specified steps may be carried out concurrently unless explicit claim language requires that they be carried out separately or as parts of different processing operations. For example, a claimed step of doing X and a claimed step of doing Y may be conducted simultaneously within a single operation, and the resulting process will be covered by the claim. Thus, a step of doing X, a step of doing Y, and a step of doing Z may be conducted simultaneously within a single process step, or in two separate process steps, or in three separate process steps, and that process will still fall within the four corners of a claim that recites those three steps.

Similarly, except as explicitly required by claim language, a single substance or component may meet more than a single functional requirement, provided that the single substance fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention. Applicants reserve the right to physically incorporate into this specification any and all materials and information from any such patents, applications, publications, scientific articles, web sites, electronically available information, and other referenced materials or documents. Applicants reserve the right to physically incorporate into any part of this document, including any part of the written description, the claims referred to above including but not limited to any original claims.

What is claimed is:

1. A variable speed limit sign comprising:

a controller comprising:

a first radio clock with an output to synchronize the controller with a traffic control device synchronized by a second radio clock, wherein the traffic control device is programmed with a predictable output schedule;

a programmable memory device containing a timing sequence of the traffic control device and one or more traffic schedules;

a processor for determining a variable speed limit for a vehicle to maintain to avoid a stop signal at the traffic control device, wherein the variable speed limit places the vehicle at the traffic control device at a precise time with a precise velocity and with a predetermined time delay so that the vehicle will not overtake a preceding vehicle; and a display operatively coupled to the controller for communicating the variable speed limit to the vehicle.

2. The variable speed limit sign of claim 1, wherein the first and second radio clocks are synchronized by a time code bit stream transmitted by one or more radio transmitters, wherein the one or more radio transmitters are connected to a time standard.

3. The variable speed limit sign of claim 2, wherein the one or more radio transmitters each independently comprise a national time transmitter, a regional time transmitter, a satellite navigation system transmitter, or a combination thereof.

4. The variable speed limit sign of claim 2, wherein the time standard is a radio controlled clock.

5. The variable speed limit sign of claim 1, further comprising a power source operatively coupled to the variable speed limit sign.

6. The variable speed limit sign of claim 5, wherein the power source comprises a solar panel array, a battery, an external power source, or a combination thereof.

7. The variable speed limit sign of claim 1, further comprising one or more sensors for determining road conditions, weather condition, traffic conditions, emergency conditions, or a combination thereof.

8. The variable speed limit sign of claim 1, further comprise one or more signal receivers to receive one or more signals sent by the central control station or an emergency vehicle.

9. The variable speed limit sign of claim 8, wherein the one or more signals instruct the controller to switch to a second traffic schedule.

10. The variable speed limit sign of claim 1, wherein the processor determines the variable speed limit by using the timing sequence of the traffic control device contained within the programmable memory device and the one or more traffic schedules.

11. The variable speed limit sign of claim 1, wherein the processor comprises override mechanism to provide a static speed limit to the display, a text message to the display, a symbol to the display, or a combination thereof.

12. The variable speed limit sign of claim 1, further comprising a self-diagnosis device for verifying that the operation of the controller and the display are within predefined tolerances.

13. The variable speed limit sign of claim 1, wherein the traffic control device is at an intersection, on a controlled merging on-ramp, or a combination thereof.

14. A traffic control system comprising:

a traffic control device that is preprogrammed by a central control station synchronized by a first radio clock;

one or more variable speed limit signs for communicating with a first oncoming vehicle a variable speed limit to avoid a stop signal in the traffic control device comprising:

a controller comprising:

a first radio clock with an output to synchronize the controller with a traffic control device synchronized by a second radio clock, wherein the traffic control device is programmed with a predictable output schedule;

a programmable memory device containing a timing sequence of the traffic control device and one or more traffic schedules;

a processor for determining the variable speed limit for a vehicle to maintain to avoid a stop signal at the traffic control device, wherein the variable speed limit places the vehicle at the traffic control device at a precise time with a precise velocity and with a predetermined time delay so that the vehicle will not overtake a preceding vehicle; and a display operatively coupled to the controller for communicating the variable speed limit to the vehicle or optionally display, transmit, or display and transmit a programming status of the controller.

15. The traffic control system of claim 14, wherein the first and second radio clocks are synchronized by a time code bit stream transmitted by one or more radio transmitters, wherein the one or more radio transmitters are connected to a time standard.

16. The traffic control system of claim 14, further comprise one or more signal receivers to receive one or more signals sent by the central control station or an emergency vehicle.

17. The traffic control system of claim 16, wherein the one or more signals instruct the controller to switch to a second traffic schedule.

18. A method of regulating traffic with a variable speed limit sign comprising:

providing a variable speed limit sign synchronized using a first radio clock with a traffic control device synchronized with a second radio clock;

determining the time before the traffic control device displays a stop signal;

determining the variable speed that a vehicle should maintain to avoid the stop signal at the traffic control device;

displaying the required speed for the vehicle to maintain to avoid the stop signal at the traffic control device;

wherein the variable speed limit sign comprises:

a controller comprising:

a first radio clock with an output to synchronize the controller with a traffic control device synchronized by a second radio clock, wherein the traffic control device is programmed with a predictable output schedule;

a programmable memory device containing a timing sequence of the traffic control device and one or more traffic schedules;

a processor for determining a variable speed limit for a vehicle to maintain to avoid a stop signal at the traffic control device, wherein the variable speed limit places the vehicle at the traffic control device at a precise time with a precise velocity and with a predetermined time delay so that the vehicle will not overtake a preceding vehicle; and a display operatively coupled to the controller for communicating the variable speed limit to the vehicle.

19. The method of regulating traffic of claim 18, wherein the first and second radio clocks are synchronized by a time code bit stream transmitted by one or more radio transmitters, wherein the one or more radio transmitters are connected to a time standard.

20. The method of regulating traffic of claim 18, wherein a second display output provides the speed that will provide a left hand turn or a right hand turn at the next traffic controller.

* * * * *